United States Patent [19]

Le Bret

[11] Patent Number: 4,626,158

[45] Date of Patent: Dec. 2, 1986

[54] CONTAINER SEAM AND A PROCESS FOR FORMING A CONTAINER SEAM

[75] Inventor: Lucien F. Le Bret, Saint Gratien, France

[73] Assignee: Gallay S.A., Paris, France

[21] Appl. No.: 627,931

[22] Filed: Jul. 5, 1984

[30] Foreign Application Priority Data

Jul. 5, 1983 [FR] France ..... 83 11188
Sep. 30, 1983 [FR] France ..... 83 15596

[51] Int. Cl.[4] ..... B21D 51/30
[52] U.S. Cl. ..... 413/6; 413/4
[58] Field of Search ..... 413/4, 5, 6, 7, 8, 27, 413/37; 220/66, 67

[56] References Cited

U.S. PATENT DOCUMENTS

| | | | |
|---|---|---|---|
| 1,507,304 | 9/1924 | Blair . | |
| 1,736,422 | 11/1929 | Wellings | 413/4 |
| 1,766,173 | 6/1930 | Mills | 413/4 |
| 2,169,395 | 8/1939 | Rheen | 413/4 |
| 2,239,696 | 4/1941 | Bohm . | |
| 3,263,636 | 8/1966 | Smith | 413/6 |
| 3,672,317 | 6/1972 | Walker . | |
| 3,765,351 | 10/1973 | Kubacki . | |
| 3,882,763 | 5/1975 | Ellerbrock | 413/7 |
| 4,538,758 | 9/1985 | Griffith | 413/4 |

FOREIGN PATENT DOCUMENTS

| | | |
|---|---|---|
| 793875 | 11/1973 | Belgium . |
| 0065842 | 12/1982 | European Pat. Off. . |
| 82066 | 6/1983 | European Pat. Off. . |
| 334017 | 12/1903 | France . |
| 375977 | 7/1907 | France . |
| 1447436 | 6/1966 | France . |
| 89175 | 4/1967 | France . |
| 2056925 | 5/1971 | France . |
| 2184820 | 12/1973 | France . |
| 2184920 | 12/1973 | France . |
| 1319439 | 12/1977 | France . |
| 2440789 | 11/1978 | France . |
| 2430276 | 1/1980 | France . |
| 55-40094 | 3/1980 | Japan . |
| 602423 | 7/1978 | Switzerland . |
| 142967 | 5/1920 | United Kingdom . |
| 1095216 | 12/1967 | United Kingdom . |
| 1124968 | 8/1968 | United Kingdom . |

*Primary Examiner*—Leon Gilden
*Attorney, Agent, or Firm*—Pennie & Edmonds

[57] ABSTRACT

A triple seam for assemblying a bottom to a container body, and a process for forming the triple seam. The process comprises the step of forming an axially extending seaming structure comprising a plurality of layers belonging to adjoining edges of the body and bottom. One of the adjoining edges includes a first layer and a contiguous overfolded second layer having an axial length less than the axial length of said first layer to increase the number of layers in a first axial section of the seaming structure. The process also includes the step of lamination rolling the seaming structure to a uniform width. A hook-shaped profile is formed in said body edge as a preliminary step in this process.

16 Claims, 18 Drawing Figures

CONTAINER SEAM AND A PROCESS FOR FORMING A CONTAINER SEAM

BACKGROUND OF THE INVENTION

The present invention relates to seamed joints, namely for packagings with a top and a bottom assembled by seaming, and in particular to seamed joints of this type for metallic drums or the like. The joints are of the kind in which the adjacent edges of the body and of the bottom form generally alternating layers of an intermixed structure extending a certain height in an axial direction. The seams, called simple, double and triple, are well known and respectively consist of three, five and seven layers of the material. The double and the triple seams correspond to the most currently used technical processes in the manufacturing of metallic drums or composite drums.

The seam is often the zone or area of a package or container which is most exposed to dislocation, particularly in the case of an accidental drop. Consequently, means and ways of improving the mechanical resistance or strength of this kind of joint have been investigated for a long time.

As far back as 1919 (see British Pat. No. 142.967), a process directed to the reinforcement of a seamed joint has been described. That process consists of overfolding the edge of the bottom on itself so as to bring it in overthickness during seaming. After that operation, the seaming was performed in such a way that the adjoining parts of the bottom and of the body are present to form a bending of the seam structure along its height.

Belgian Pat. No. 793 875 describes the use of such a process applied to double seamings and points out that the overfolding may be made either on the edge of the bottom, or on the edge of the body of a metallic drum or the like.

That kind of process leads to structures of assembled joints, which are confined between two limiting surfaces of which at least one presents a bending of an amplitude corresponding roughly to the overwidth formed by the previous overfolding of one of the assembled parts. If, for instance, the profile of the outside surface of the joint is kept and maintained practically straight, the result is that the profile of the inside surface of the joint will be bent or curved. This imposes a sinuous shape or course in the internal structure of the joint which will mainly affect the layer or the layers located between the inside surface of the joint and the overfolded layer which causes the overthickness.

A seam structure made in that way improves the mechanical performances of the joint in certain situations. Experience shows, nevertheless, that this improvement remains limited, namely owing to the fact that the amplitude of the bending is restricted to the overthickness created by the thickness of the body itself.

French Pat. No. 1,447,436 and the first additional certificate No. 89 175, describe a technical process for the assembly of a bottom upon the body of a container leading to a bonding seam consisting of more than five thicknesses of steal sheet, namely a triple seam with seven thicknesses of steal sheet. That process is essentially characterized by the fact that the radial edge of the bottom is pushed back before the edge of the body is pushed back. This causes the bottom edge to wind along and around the body edge.

French Pat. No. 7523885 describes a development of that triple seam process consisting essentially of a preparation procedure for the bottom edge. Prior to rolling the two edges around one another, the peripheral zone of the bottom edge is bent a predetermined angle in the direction of the body edge and a small, open hook is formed in that peripheral zone, with the open side of that hook facing the axis of the drum body.

SUMMARY OF THE INVENTION

Again with a view to strengthening the mechanical performance of the joints of the considered type, the present invention offers a technical process capable of increasing in a surprising manner the efficiency of the strengthening action obtained.

The process starts with the overfolding on itself of one of the adjacent edges of the parts to be assembled by seaming. The resulting seam structure has a given height and comprises a plurality of layers belonging alternatively to each of the two adjacent edges. The overfold increases the number of layers in a previously determined fraction of said given height. The process, according to the invention, is essentially characterized by a laminating operation of the structure obtained, which results in all the given height having a final evenly equalized thickness.

The overfolding is embedded into the metal of the adjoining layers with a thinning effect of all the layers, more or less pronounced according to each of them. The overfolding is thus transformed into a kind of "nucleus" firmly anchored between the adjoining layers which in turn are hardened by a kind of cold rolling.

The reinforcement obtained by means of the present invention can be explained by two facts. The first is that the lamination operation, performed according to the invention, causes a bending which affects all the interfaces in the overthickness zone, while with the previously applied process only roughly one half of the interfaces was submitted to bending. The second is that the limit of elasticity of the material can be largely exceeded in the whole overthickness zone affected by the lamination, while in the previous process the elasticity of the layers submitted to the bending was practically unaffected and did leave a tendency of the steel-sheet foldings to unfold. After the lamination performed according to the invention, this tendency to unfold can practically be suppressed: "the nerve of the steel-sheets" can be "broken" as the picturesque saying of the men of the art proclaims.

Another problem to be solved remains that of making in the optimal industrial conditions a seam of the edges of the bottom and of the body offering together the maximum of strength and a perfect watertight seal. The present invention also presents a new process to obtain a triple seam, which is characterized essentially by a preparatory operation on the edge of the body.

This preparatory operation, according to the invention, is to form a hook-shaped profile into a terminal part of the body. That operation is performed prior to flanging an edge of the terminal part of the body.

Practice shows that such a preparation of the body edge makes it possible to obtain a triple seam of good quality. At the same time, this preparation makes adjustment of the seaming machine easier and make obtaining specified manufacturing tolerances less burdensome.

The characteristics and the advantages of the invention will be shown in the hereafter description, given as a descriptive instance which is not limiting, showing a way of carrying out the invention, with reference to the attached drawings.

BRIEF DESCRIPTION OF THE DRAWINGS

The FIGS. 1 to 7 are schematic partial representations, in cut view, of the various phases of the process according to the invention.

DETAILED DESCRIPTION OF THE PREFERRED EMBODIMENTS

Figure 1:
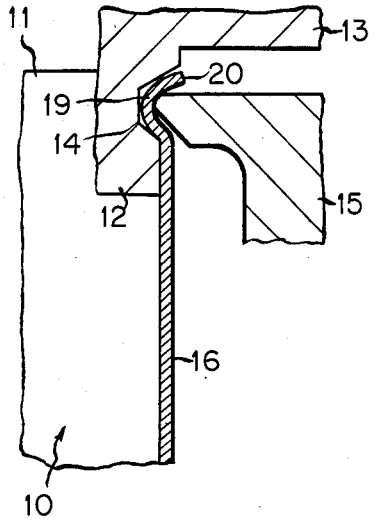
FIG. 1 shows a preparatory phase of the body edge.

According to the process represented in the drawings, the end (11) of the body (10) of a generally cylindrically shaped metallic drum that is intended to be closed by a bottom is subjected, as shown in FIG. 1, to a preparatory operation. To reach that end, axially protruding part (12) of a chuck plate (13), presenting a groove (14) facing a seaming roll (15), is moved past a terminal part of end (11). Roll (15) has a profile specially adapted to push back the outside wall of body (10) upon engaging the face (16) of the wall. The result of this preparatory operation on the terminal part of the body, is the formation in that terminal part of a hoop with a hook profile (19) which matches the profile of the groove (14) of the chuck plate and ends with a flat edge or a flat beak (20) forming an angle between 30° and 45° with the axis of the body 10. This hook (19) includes a root branch extending toward the interior of the drum body, and a terminal branch extending away from the drum body.

Figure 2:
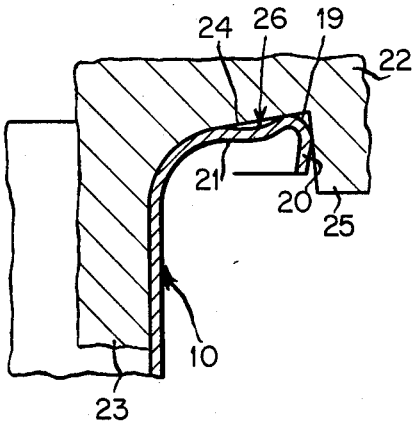
FIG. 2 illustrates the forming of the edge of the body to be seamed.

The following operation, illustrated in FIG. 2, is the formation of an edge (21) to be seamed. This is done by means of a flanging press (22) of usual type, which has a punching part (23) and a carrying back bent zone (24) terminating in a stopping edge (25).

The flange to be seamed (21) is overfolded in a plane roughly perpendicular to the axis of the body 10. The flange to be seamed includes an annular depression 26 radially inside the hoop with hook profile (19) previously formed. The flat edge formed by the beak (20), after having been submitted to a rotation of approximately 90°, lays bent towards the inside of the body.

After retraction of the press (22), the third step is the placing inside the ringshaped depression (26) of a plastic sealant material. This operation can be performed by aid of a roll, the sealing material, being at that stage in a fluid state, is shown in FIG. 3.

Figure 3:
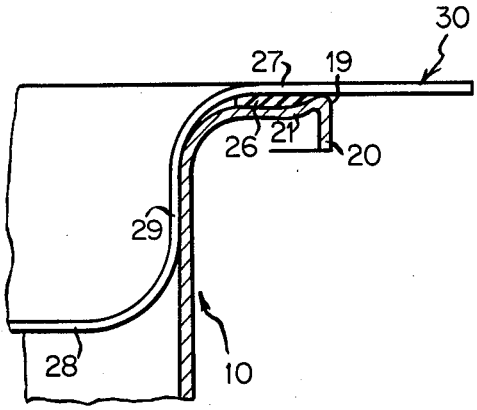
FIG. 3 shows the positioning of the bottom after application of the joint sealant.

FIG. 3 also shows the result of the positioning of a bottom (28) into the body of the container. The bottom has an adaptation part (29) and a bottom edge (30) which extends in the radial direction a preset distance past the beak (20) of the edge to be seamed (21) of the drum body (10). The depression (26) is located on the major part of the body edge, radially inside the high portion of hook (19) upon which the bottom edge (30) comes in pressure contact.

Figure 4:
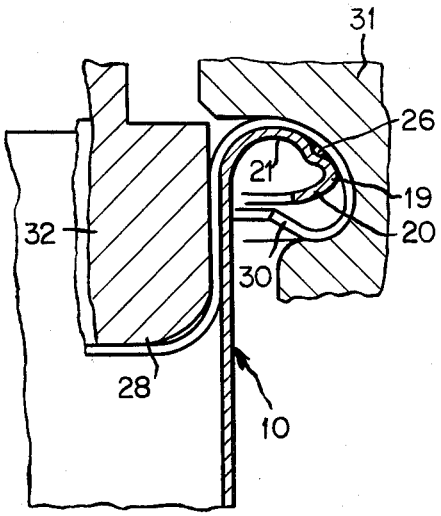
FIG. 4 shows the rolling of the seam.

The actual seaming operation is carried out in classical manner by means of a rolling roll (31) (FIG. 4) which is gradually advanced towards the bar of the chuck-plate (32). The edge of the bottom (30) is gradually rolled over the hook (19) up to the end of the final stage of the rolling operation illustrated on FIG. 5. The terminal part of the bottom edge (30) reaches, after a rotational movement of about 270°, a position alongside the wall of the body (10). At the same time, the beak (20) of the edge of the body has been rotated more than 90° from the position shown in FIG. 3.

During this operation, the sealant material is widely spread and compressed between the bottom edge (30) and the edge of the body, and the depression (26) may be straightened somewhat as a result of the rolling.

Figure 7:
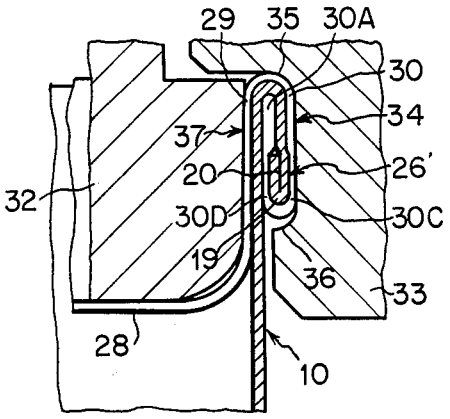
FIGS. 6 and 7 show the final tightening of the seam.
Figure 6:
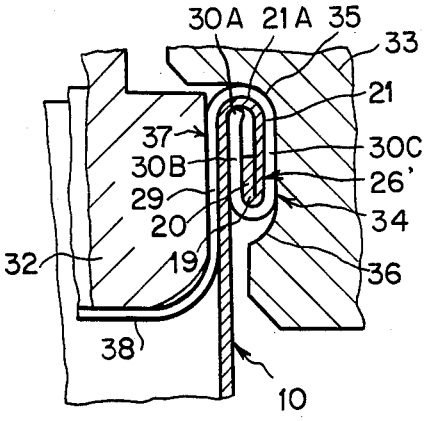

According to the invention, the sealing operation ends with the steps illustrated on FIGS. 6 and 7. The rolling roll (31) is replaced by a clamping and tightening roll (33), which presents a working surface (34) having a profile roughly straight between two curved parts (35), (36). The roll (31) confines the seam structure in front of the acting part (37) of the chuck-plate (32).

Figure 5:
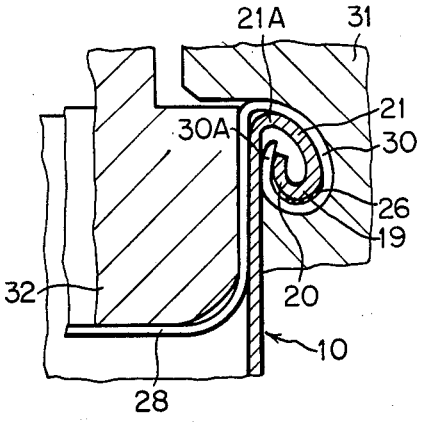
FIG. 5 illustrates the end of the rolling operation.

Starting from the position illustrated on FIG. 5, when the working action of the rolling roll (31) has been performed, the intervention of the tightening roll (33) can be analyzed in two steps.

In a first part, the run of the tightening roll towards the chuck-plate (32) flattens the whole seamed zone (FIG. 6). During that flattening action, the curved shape of the edge of the bottom (30) is gradually straightened under the pressure of the surface (34) of the tightening roll. That straightening induces a backwards push of the body edge (21) with a gradual reduction of its linking radius (21A) on one side and a gradual closing of the hook (19). Hook (19) closes until the beak (20) bends against the terminal part (30A) of the bottom edge, which is gradually straightened on its side and driven against the adjoining part of the body (10).

This part of the tightening process can be regarded as completed when the surface (34) of the roll (33) has reached a distance from the opposing surface (37) of the chuck-plate (32) equal to the sum of six thicknesses of the metal sheet. This distance includes the thickness of the beak (20) between, on one hand, the body (10) which itself is driven between the positioning part (29) and the internal adjoining part (30B) of the bottom edge now overfolded and, on the other hand, the engaged part (30C) of the bottom edge which covers the adjoining part of the body edge represented with the marking (26') and which corresponds to the area previously affected by the depression (26).

The first step of the tightening process is followed, according to the invention, by a finishing step designated as a laminating step. During this step the run of the tightening roll is carried on (FIG. 7) until it reaches a distance from the surface (37) of the chuck-plate approximately equal to the total of the five thicknesses of metal sheet, which are inside in the seam axially outside the beak (20).

In this condition, the six layers of material at the level of the hook (19) are subjected to a laminating action (or to a forging action) inducing a plastic alteration of the shape of the whole seam. That alteration of shape leads to a particularly efficient anchoring or bolting of the hook (19) into the surrounding layers, acting in the way a harpoon does. It leads to a strenghtening of the entire seam structure by means of steel burning effect and to an improvement of the tightness due to the impregnated layers created in the resulting structure.

Figure 8:
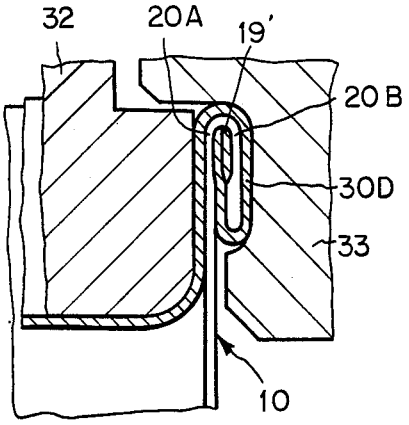
FIG. 8 is similar to FIG. 7, but shows an alternative variation with overfolding of the edge of the bottom.

FIG. 8 shows a view similar to the one of FIG. 7 and illustrates an alternate method that differs from the previous method in that the hook (19') is formed by overfolding an area of bottom edge (30D). The thinning action caused by the laminating step in this alternate method mainly affects the two folds (20A) and (20B) of the body (10').

The preparation of the adjoining edge of the bottom can be done by a shaping action similar to the profiling action described hereabove for the body edge referred to in FIG. 1. Nevertheless, it is also feasible, and it can be preferred to form a round, bent hook on the adjoining bottom edge, either before or after positioning the bottom on the body, by means of a previously made round folding.

FIGS. 9 to 12 illustrate an example of carrying out such a preparation of the bottom edge as well as the following seaming operation.

Figure 9:
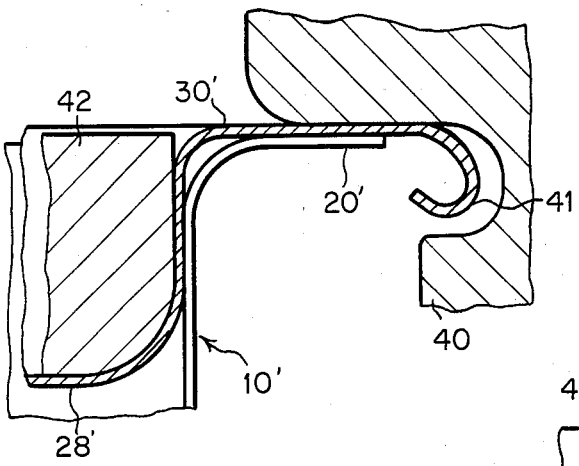
FIGS. 9 to 12 illustrate various successive phases of the way to carry out the alternative variation of FIG. 8.

According to FIG. 9, the adjoining area of the edge (30') of a bottom (28') presents a profile (41) in the shape of a round hook, which is shaped by rolling. This, in turn, can be done, either before or after locating the bottom into the body (10'), with a plainly folded edge (20').

Figure 11:
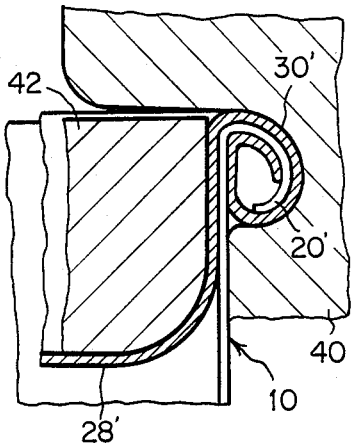
Figure 10:
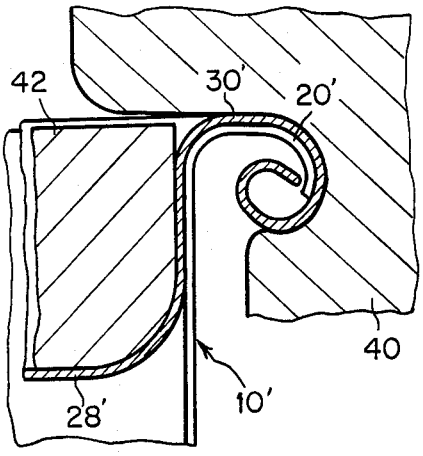
Figure 12:
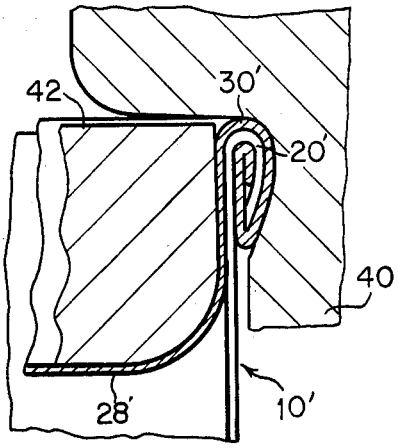

The whole assembly thus prepared is subjected to the actions, one after the other, of two seaming rolls. A first seaming roll (40), which FIGS. 9 to 11 show in three successive positions, faces a chuck-plate (42), and a second, tightening roll (40') which carries out the seaming, as in FIG. 12, prior to the laminating operation, according to the invention.

A finishing laminating step can be done according to the description made hereabove.

FIGS. 13 through 18 show another method for forming a triple seam employing the preparatory operation illustrated in FIGS. 1, 2 and 3. In particular, FIGS. 13 through 18 show successive phases of that final step of forming the triple seam operation which consists in the simultaneous rolling on each other of the bottom edge and of the body edge. The hook (19) and the hem (31) will be designated on these figures by references bearing subscripts corresponding to the successive states in which they are shown.

Figure 13:
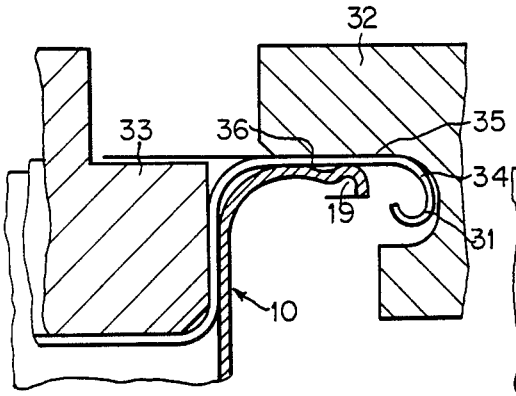
FIGS. 13 to 18 show another method for forming a triple seam employing the preparatory operation illustrated in FIGS. 1, 2 and 3.
Figure 14:
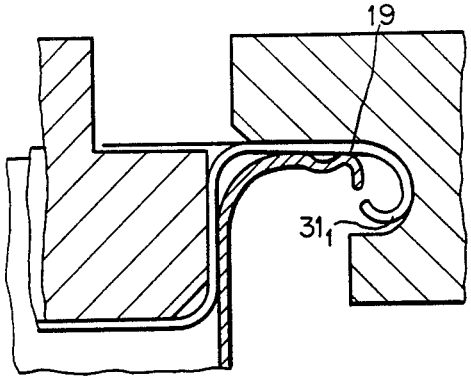
Figure 17:
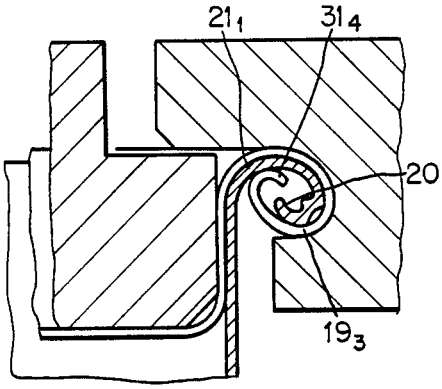
Figure 15:
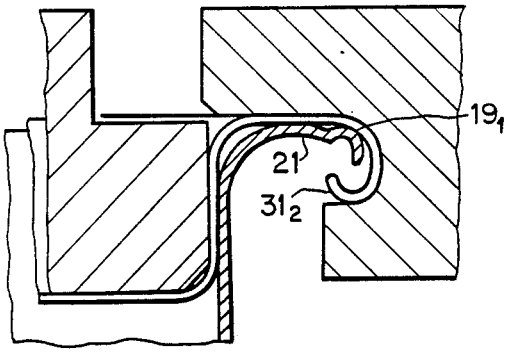

In FIG. 13 it will be noticed that at the start of the progression of the roll (32) towards the chuck (33), only the adjacent part of the bottom edge is deformed. FIG. 14 shows the increasing deformation of that adjacent part of the bottom edge, ($31_1$) as that adjacent part approaches the beak 19. FIG. 15 shows the beginning of the combined deformation of the edge of the bottom edge (31) and the body (21), the hook of the body edge being pushed back at ($19_1$) by the adjoining area of the bottom edge. At this stage, hem ($31_2$) is beginning to penetrate into the inner part of the hook ($19_1$).

Figure 16:
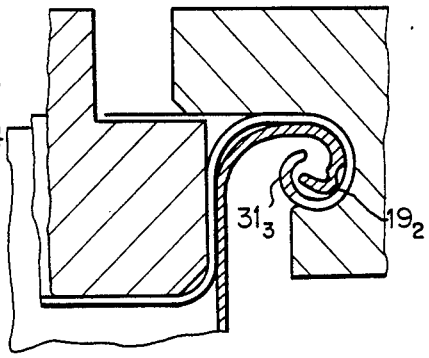
Figure 18:
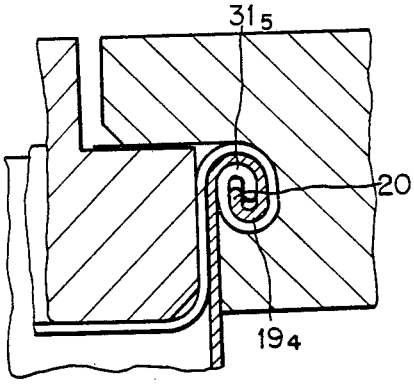

With reference to FIG. 16, the continuation of the rolling operation results in a more extended wrapping of the body edge by the bottom edge, the hem of the bottom edge being at ($31_3$) and the hook of the body edge being at ($19_2$). In the step depicted in the FIG. 17, the highest part (summit) of the hem ($31_4$) of the bottom edge has reached a stopped position against the body edge ($21_1$). At the same time, the beek (20) of the hook ($19_3$) is in a position facing the open part of the hem of the bottom edge at ($31_4$). FIG. 18 illustrates the end of that final phase—a triple seam comprised of seven layers or seven thicknesses of material.

With the method shown in FIGS. 13 to 18, the small adjacent edge (20) keeps its predetermined dimension fixed in the preparatory step (FIG. 1) and is located inside the heart of the seamed assembly of seven layers of steel sheet.

The invention, of course, is not limited to the details of performing the processes, which have been described here as illustrations. Therefore, the seaming joint can be positioned or injected, according to known technical processes, during the rolling operations of FIGS. 3 and 4 or of FIGS. 9 and 10. As regards the hook (19), it can be obtained with every kind of means other than a chuck and a roll, for instance by using grips or appropriate jaws.

I claim:

1. A process for assembling a container body and a bottom therefor by forming a triple seam between the body and the bottom of the container comprising the steps of:

(a) forming a hook-shaped profile in the edge of the body of the container;

(b) superposing a bottom edge of the bottom of the container over the hooked edge of the body of the container;

(c) flanging a terminal part of said body subsequent to the step of forming the hook-shaped profile in the body edge; said body edge having:

(i) the hook-shaped profile with a generally axially extending terminal part; and (d) rolling the bottom and body edges around each other to form a triple seam having more than five layers of adjoining material.

2. A process for assembling a container body and a bottom therfor by forming a triple seam between the body and bottom of the container comprising the steps of:

(a) forming a hook-shaped profile in the edge of the body of the container;

(b) superposing a bottom edge of the bottom the the container over the hooked edge of the body;

(c) flanging a terminal part of said body subsequent to the step of forming the hooked-shaped profile in the body edge, said body edge having:

(i) the hook-shaped profile with a generally axially extending terminal part (20), and (ii) an annular depression (26) radially inside said hook-shaped profile; and (d) rolling the bottom and body edges around each other to form a triple seam having more than five layers of adjoining material.

3. A process according to claim 2 wherein the hook-shaped profile is formed by means of a chuck and of a roll having complementary profiles.

4. A process according to claims 2 or 3 wherein prior to the flanging step the hook-shaped profile includes:

(a) forming a root branch extending toward the inside of the body; and (b) forming a terminal branch extending away from the inside of the body.

5. A process according to claims 2 or 3 wherein the body edge is driven down by means of a press.

6. A process for assembling a container body and bottom therefor by forming a triple seam between the body and the bottom of the container comprising the steps of:

(a) forming a hook-shaped profile in the edge of the body of the container;
(b) forming a flange on said body;
(c) forming an annular depression in said flange between the hook-shaped profile (19) and a portion of the flange connecting the flange to an unaltered portion of the body;
(d) superposing a bottom edge of the bottom of the container over the hooked edge of the body; and,
(e) rolling the bottom and body edges around each other to form a triple seam having more than five layers of adjoining material.

7. A process according to any one of claims 2, 3 or 6 further including the step of:
(a) positioning a liquid sealant in the annular depression prior to the superposing step.

8. A process for assemblying a container body and a bottom therefor, comprising the steps of:
(a) forming an axially extending seaming structure comprising a plurality of layers belonging to adjoining edges of the body and bottom, one of said adjoining edges including a first layer formed from said one edge and a contiguous overfolded second layer formed from said one edge and having an axial length less than the axial length of said first layer to increase the number of layers in a first axial section of the seaming structure; and
(b) lamination rolling the seaming structure to a uniform width.

9. A process according to claim 8 wherein said first and second layers are formed on the adjoining edge of the bottom.

10. A process according to claim 8 wherein said first and second layers are formed on the adjoining edge of the body, and the forming step includes the step of forming a hook shaped profile in a terminal part of the edge of the body.

11. A process according to claim 10 wherein the hook shaped profile is formed by operation of a roll and of a chuck-plate having complementary profiles.

12. A process according to claims 10 or 11 wherein the hook shaped profile includes a root branch extending toward the interior of the body, and a terminal branch extending away from the body.

13. A process according to claims 10 or 11 wherein the edge of the body is bent outward after formation of the hook-shaped profile to form a flange.

14. A process for assembling a container body and a bottom therefor, comprising the steps of:
(a) forming an axially extending seaming structure comprising a plurality of layers belonging to adjoining edges of the body and bottom, one of said adjoining edge of said body including a first layer and a contiguous overfolded second layer having an axial length less than the axial length of said first layer to increase the number of layers in a first axial section of the seaming structure;
(b) forming a hook shaped profile in a terminal part of the edge of the body during said forming of said seaming structure;
(c) bending the edge of the body outward after formation of the hook-shaped profile to form a flange which extends outward from an unaltered portion of a wall of the body;
(d) forming an annular depression, concave toward the outside of the body in the flange between a raised portion of the hook-shaped profile and an inside edge of the flange, and,
(e) lamination rolling the seaming structure to a uniform width.

15. A process according to claim 14 wherein the step of forming the seaming structure further includes the step of applying a sealant in said annular depression.

16. A process according to any one of claims 8, 9, 10 or 11 wherein the step of forming the seaming structure includes the steps of:
(a) positioning the bottom adjacent the body; and
(b) subsequently engaging an edge of the bottom, around the edge of the body, first with a rolling roll (31) and then with a laminating roll (33) having a working surface with a profile approximately parallel to a surface of a chuck-plate which supports the body and the bottom.

* * * * *